US007928914B2

(12) United States Patent
Bit-Babik et al.

(10) Patent No.: US 7,928,914 B2
(45) Date of Patent: Apr. 19, 2011

(54) MULTI-FREQUENCY CONDUCTIVE-STRIP ANTENNA SYSTEM

(75) Inventors: Giorgi G. Bit-Babik, Sunrise, FL (US); Carlo Di Nallo, Plantation, FL (US); Antonio Faraone, Plantation, FL (US)

(73) Assignee: Motorola Mobility, Inc., Libertyville, IL (US)

( * ) Notice: Subject to any disclaimer, the term of this patent is extended or adjusted under 35 U.S.C. 154(b) by 1432 days.

(21) Appl. No.: 10/945,234

(22) Filed: Sep. 20, 2004

(65) Prior Publication Data

US 2005/0280586 A1 Dec. 22, 2005

(51) Int. Cl.
*H01Q 1/24* (2006.01)

(52) U.S. Cl. ..... 343/702; 343/846

(58) Field of Classification Search ..... 343/702
See application file for complete search history.

(56) References Cited

U.S. PATENT DOCUMENTS

| | | | | |
|---|---|---|---|---|
| 5,767,810 | A | 6/1998 | Hagiwara et al. | |
| 6,307,512 | B1 | 10/2001 | Geeraert | |
| 6,504,507 | B2 | 1/2003 | Geeraert | |
| 6,664,931 | B1 | 12/2003 | Nguyen et al. | |
| 6,819,287 | B2 * | 11/2004 | Sullivan et al. | 343/700 MS |
| 6,822,611 | B1 * | 11/2004 | Kontogeorgakis et al. | 343/702 |
| 6,903,686 | B2 * | 6/2005 | Vance et al. | 343/700 MS |
| 2001/0043159 | A1 | 11/2001 | Masuda et al. | |
| 2001/0054979 | A1 | 12/2001 | Bahr et al. | |
| 2002/0079743 | A1 | 6/2002 | Ma et al. | |
| 2002/0109635 | A1 | 8/2002 | Geeraert | |
| 2002/0149526 | A1 | 10/2002 | Tran et al. | |
| 2003/0142022 | A1 * | 7/2003 | Ollikainen et al. | 343/702 |
| 2004/0075611 | A1 * | 4/2004 | Kenoun et al. | 343/702 |

FOREIGN PATENT DOCUMENTS

| | | | |
|---|---|---|---|
| GB | 2284712 | A | 6/1995 |
| WO | 02067375 | A1 | 8/2002 |
| WO | 03096474 | A1 | 11/2003 |

OTHER PUBLICATIONS

Ollikainen, J.; Kivekas, O.; Vainikainen, P. "Low-Loss Tuning Cirtuits for Frequency-Tunable Small Resonant Antennas" Helsinki University of Technology IEEE 2002 PIMRC 2002.

* cited by examiner

*Primary Examiner* — Hung T Vy
*Assistant Examiner* — Binh V Ho

(57) ABSTRACT

To address the above-mentioned need an antenna (100) is provided having a conductive-strip radiating element (102) supported above a substrate (206) via three legs (201-203). The point where the substrate contacts the three legs form two antenna ports and a ground utilized for feeding the RF signal, tuning the antenna, and grounding. More particularly, a first leg (201) of the radiating element is used solely as a tuning port, while a second leg (202) is grounded, and a third leg (203) is utilized solely as a feed port. The tuning port is substantially maximally distal to the feed port on the substrate. Reactive loads are provided at the tuning port to effectively tune the central operating frequency of the antenna.

19 Claims, 3 Drawing Sheets

MULTI-FREQUENCY CONDUCTIVE-STRIP ANTENNA SYSTEM

FIELD OF THE INVENTION

The present invention relates generally to antennas and in particular to a multi-frequency antenna system.

BACKGROUND OF THE INVENTION

Wireless communications technology today requires cellular radiotelephone products that have the capability of operating in multiple frequency bands. The normal operating frequency bands, in the United States for example, are analog, Code Division Multiple Access (CDMA) or Time Division Multiple Access (TDMA) or Global System for Mobile Communications (GSM) at 800 MHz, Global Positioning System (GPS) at 1500 MHz, Personal Communication System (PCS) at 1900 MHz and Bluetooth™ at 2400 MHz. Whereas in Europe, the normal operating frequency bands are Global System for Mobile Communications (GSM) at 900 MHz, GPS at 1500 MHz, Digital Communication System (DCS) at 1800 MHz and Bluetooth™ at 2400 MHz. The capability to operate on these multiple frequency bands requires an antenna structure able to cover at least these frequencies.

External antenna structures, such as retractable and fixed "stubby" antennas (comprising one or multiple coils and/or straight radiating elements) have been used with multiple antenna elements to cover the frequency bands of interest. However, these antennas, by their very nature of extending outside of the radiotelephone and of having a fragile construction, are prone to damage and may be aesthetically unpleasant. As the size of radiotelephones shrink, users are more likely to place the phone in pockets or purses where they are subject to jostling and flexing forces that can damage the antenna. Moreover, retractable antennas are less efficient in some frequency bands when retracted, and users are not likely to always extend the antenna in use since this requires extra effort. Further, marketing studies also reveal that users today prefer internal antennas to external antennas.

The trend is for radiotelephones to incorporate fixed antennas contained internally within the radiotelephone. At the same time, antenna bandwidth and efficiency are fundamentally limited by its electrical size. One known approach to overcome this problem is to use matching networks to match the antenna and source impedances over a specific frequency band. However, if the antenna is narrowband (because of its small size) to begin with, there is only limited increase in bandwidth that can be achieved before serious degradation of the radiated efficiency occurs. Therefore, there is a need for a small size and low cost internal antenna apparatus with and multi-band frequency radiation capability. It would also be of benefit to provide this antenna apparatus driven by a single excitation port.

DETAILED DESCRIPTION OF THE DRAWINGS

To address the above-mentioned need an antenna is provided having a conductive-strip radiating element supported above a substrate via three legs. The substrate incorporates a ground plane formed by a single conductive layer, or by multiple conductive surfaces placed at one or multiple substrate layers, said surfaces being suitably interconnected to perform the same electrical function as a single, continuous conductive layer. The three legs are utilized as two antenna ports and a ground. More particularly, the points where the substrate contacts the three legs form two antenna ports and a ground utilized for tuning the RF signal, grounding and feeding the antenna. A first leg of the radiating element is used solely for tuning, while a second leg is used as a ground. A third leg is utilized solely for feeding the antenna. The tuning port, and hence the first leg is substantially maximally distal to the feed port, and hence the third leg on the substrate. Reactive loads are provided at the tuning port/first leg to effectively tune the central operating frequency of the antenna.

The disclosed antenna structure and the method of its instant tuning can be used for example in Software Defined Radio applications where the antenna operating frequency can be controlled by software and can be tuned over a wide frequency range. Additionally, the above-described antenna can be utilized when the volume provided for the antenna is too small to cover several closely spaced frequency bands simultaneously. In this case, a small tunable antenna structure can be used to cover one band at a time and be instantly tuned to other bands as well.

The present invention encompasses an antenna system comprising a ground plane and a radiating element electrically contacting the ground plane at a first, second, and a third point. In the preferred embodiment of the present invention the first point is utilized as a ground for the radiating element, the second point is utilized as a tuning port for the radiating element, and the third point is utilized as a feed port for the radiating element.

The present invention additionally encompasses an antenna system comprising a ground plane, a radiating element supported above the ground plane and electrically contacting the ground plane via a first, second, and a third leg. In the preferred embodiment of the present invention the first leg is utilized as a ground for the radiating element, the second leg is utilized as a tuning port for the radiating element, and the third leg is utilized as a feed port for the radiating element.

Figure 1:
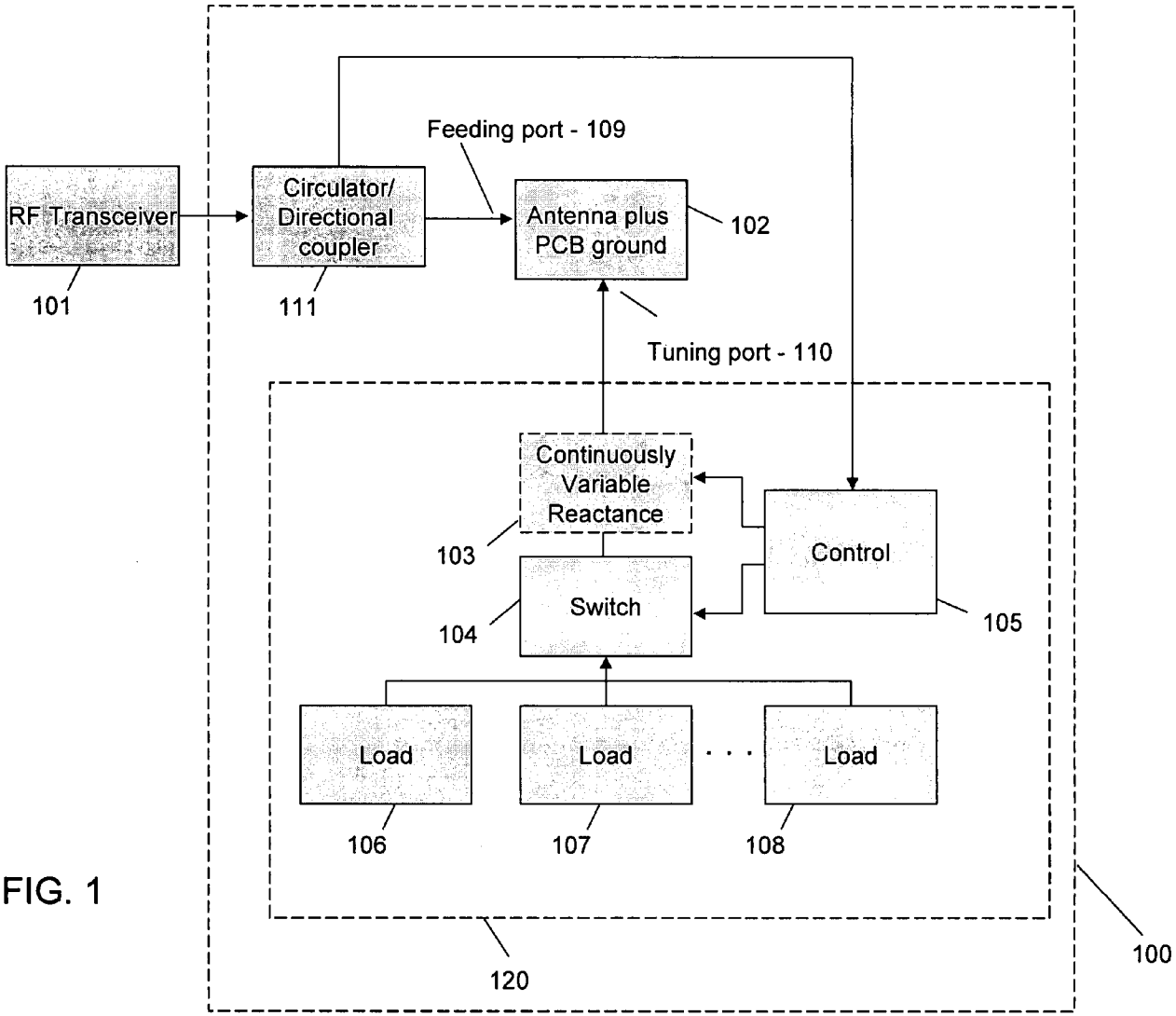
FIG. 1 is a block diagram of an antenna in accordance the preferred embodiment of the present invention.

Turning now to the drawings, wherein like numerals designate like components, FIG. 1 is a block diagram of antenna system 100 in accordance with the preferred embodiment of the present invention. Antenna system 100 is preferably contained completely within a cellular radio telephone. As shown, antenna system 100 comprises radiating structure 102 formed by a conductive-strip radiating element plus the printed circuit board ground plane, optional variable reactance tuning circuitry 103, control circuitry 105, and switched tuning network 120. Switched tuning network 120 can be realized using a variety of different topologies, one of them showed in FIG. 1 comprising an RF switch 104 and a plurality of reactive loads 106-108. Switched tuning network 120 together with the geometry of radiating structure 102 determine a central operating frequency of antenna system 100. Antenna system 100 may exhibit one or multiple operating frequencies at each tuning states, typically due to higher order resonances of the whole radiating structure 102. During operation control circuitry 105 operates switch 104 to effectively connect different reactive loads 106-108 or their combinations to radiating structure 102, and thus instantly tune antenna 100 to different frequencies. Thus, control circuitry 105 determines an operating frequency for antenna 100 and chooses a single, or multiple loads 106-108 to connect to radiating structure 102. In the preferred embodiment of the present invention, reactive loads 106-108 are non radiating elements and are realized as lumped elements or a piece of open ended or shorted transmission line printed or embedded in/on a PCB structure. Alternatively, the transmission line pieces can be closed on lumped reactive loads. Control circuitry 105 can also operate multiple switches, should the switched tuning network 120 comprise more than one RF switch.

RF switch 104 is preferably a Micro Electro-Mechanical System (MEMS)-based switch; however in alternate embodiments of the present invention, other switching technology (e.g., FET, GaAs, PIN diodes, etc.) may be utilized. RF switch 104 can be a single pole multi throw switch, which will connect one reactive load at a time, or as discussed above, may utilize differing switch architectures to connect two or more loads to the tuning port simultaneously, thus providing additional reactive load values through a suitable combination of existing loads. In one preferred embodiment of the present invention a single transmission line (strip line or micro strip line) is utilized for loads 106-108, which has a number of switches 104 along its length to ground certain point of the line and thus provide different reactive impedance at the tuning port. Alternatively, the switches 104 couple to shunt reactances coupled to ground.

As discussed, the reactive load connected to element 102 changes the central operating frequency of antenna system 100. In general a larger inductive load moves the central frequency down and smaller capacitive load moves it up. For the described structure there is a wide range of frequencies where different reactive loads do not significantly affect the impedance match between the antenna and the radio-frequency source or receiver. In other words, antenna system 100 is matched with RF transceiver 101 within the mentioned frequency range and can be tuned at a particular frequency within this range, using a suitable tuning load.

As one of ordinary skill in the art will recognize, the tuning frequency of antenna 100 can be affected by instantaneous changes in the surrounding environment. In this case additional variable reactance circuitry 103 may optionally be utilized between element 102 and switch 104 for fine tuning. Reactance circuitry 103 can be implemented using, for example, MEMS technology. As one of ordinary skill in the art will recognize, the VSWR or power sensing device 111 can be realized using, for instance, a circulator or directional coupler and diode detection circuitry to provide the appropriate feedback to control circuitry 105, which can be utilized to tune variable reactance 103 to keep the return loss for antenna at an optimum. In this configuration only one capacitance is typically sufficient for fine frequency tuning at all switching states. Because the antenna retuning frequency range by using variable reactance can be substantial, the number of different states in the switched tuning network can be reduced to provide relatively large frequency change whereas the frequency gap between those states can be covered continuously by changing value of variable reactance 103. This approach allows not only the stabilization of the antenna matching with source impedance at the desired operation frequencies, but also allows a reduction in the number of different tuning states in the switched tuning network.

Figure 2:
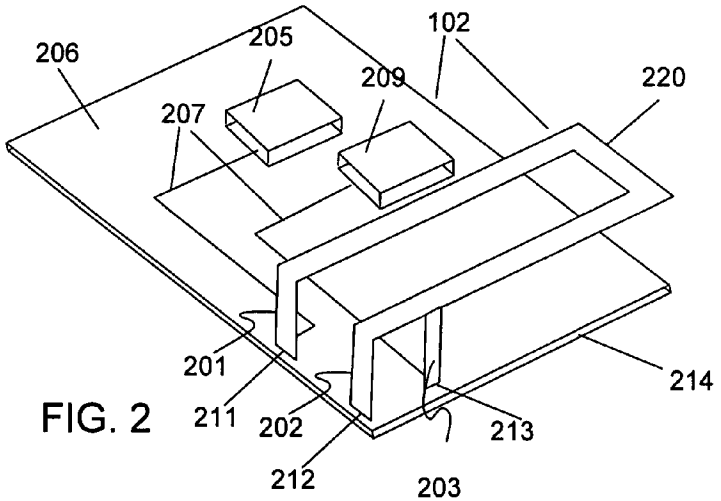
FIG. 2 shows a perspective view of the antenna apparatus of the present invention according to a first preferred embodiment.

FIG. 2 shows a perspective view of the apparatus described in FIG. 1. Radiating structure 102 is shown comprising a conductive-strip, piece of wire, or metal strip 220 located over a ground plane 214 embedded within substrate 206. The conductive strip 220 in the radiating structure 102 is about a quarter wavelength at the lowermost frequency of the tuning range. Substrate 206 preferably comprises a standard printed circuit board (PCB) or ceramic substrate. In the preferred embodiment of the present invention radiating element 220 is folded, taking on a "U-shape" to reduce dimensions. As is evident, radiating element 220 is supported above substrate 206 via legs 201-203. Legs 201-203 electrically contact the ground plane at a first 211, second 212, and third 213 point. First point 211 is utilized as a tuning port, while third point 213 is utilized as a feed port. Second point 212 is utilized as a ground. All circuitry 103-108 shown in FIG. 1 (e.g., variable reactance circuitry 103, switch 104, control circuitry 105, and loads 106-108) is located within integrated circuits and component part 205 attached to substrate 206. Tuning circuitry in part 205 and feed circuitry in part 209 (also attached to substrate 206) are connected by a feedback line (not shown) that relays information about the VSWR or reflected power at the feeding port 213/leg 203. Additionally, even though FIG. 2 shows separate tuning circuitry 205 and feed circuitry 209 coupled to feed port 213/leg 203 and tuning port 211/leg 201, one of ordinary skill in the art will recognize that tuning and feed circuitry 205 and 209 may be located on a single integrated circuit.

In the preferred embodiment of the present invention first leg 201 (at first point 211) is used solely as a tuning port, while a second leg 202 of radiating element 220 is grounded at point 212. Leg 203 (at point 213) is utilized solely as a feeding port for feeding the RF signal to radiating element 220. Leg 203, and hence point 213 is connected in close proximity to leg 202/point 212 to match radiating structure 102 with the impedance of RF transceiver 101. Typically, all necessary electrical connections between legs 201-203 and circuitry 103-108 are made via standard PCB traces 207, even though other techniques, e.g., suspended microstrip line, could be employed to realize the same electrical function. As one of ordinary skill in the art will recognize, traces 207 are not arbitrary in length. Those connected to the tuning port 211/leg 201 are part of the switched tuning network and contribute to establishing a value of the tuning reactance by transforming the reactance seen at one trace terminal to a new reactance value at the other trace terminal. For instance, if in one of the tuning states the tuning port is supposed to be grounded then the trace to connect it to the ground through the switch should be as short as possible, ideally approaching zero length, so as to introduce as low an inductance as possible.

For all embodiments discussed here and below, the length of conductive strip 220 at which frequency it becomes resonant when tuning port 211/leg 201 is grounded is approximately equal to half the radiating wavelength at said frequency. As is known, the effective electrical length of conductive strip 220 may vary depending on the capacitive coupling between the strip 220 and the ground plane 214. For instance, the capacitive coupling may be altered by a dielectric antenna support or cover.

During operation, leg 203 is coupled to RF transceiver 101 at port 213 and receives an RF signal to be radiated. Leg 201 is coupled to switch 104 and ultimately to a plurality of loads 106-108 (embodied within circuitry 205 or realized on or within the substrate 206), and is solely utilized for tuning antenna system 100. As described above, ground plane 214 is provided embedded within substrate 206. Radiating element 220 is grounded via leg 202 contacting ground plane 214 at point 212. Tuning port 211 (and leg 201) is substantially maximally distal along the path described by radiating element 220 to the feed port 213 (and leg 203) on substrate 206. This is because in this configuration, the tuning port can most effectively change the resonant length of the radiating element 220 without affecting significantly the impedance match to the RF transceiver within the tunability frequency range of the antenna as much as it would if it were placed significantly closer to the feeding port. The input impedance of the antenna is mainly determined by the radiating element 220, ground plane 214 and the position of the feed 203 and grounded leg 202.

Figure 3:
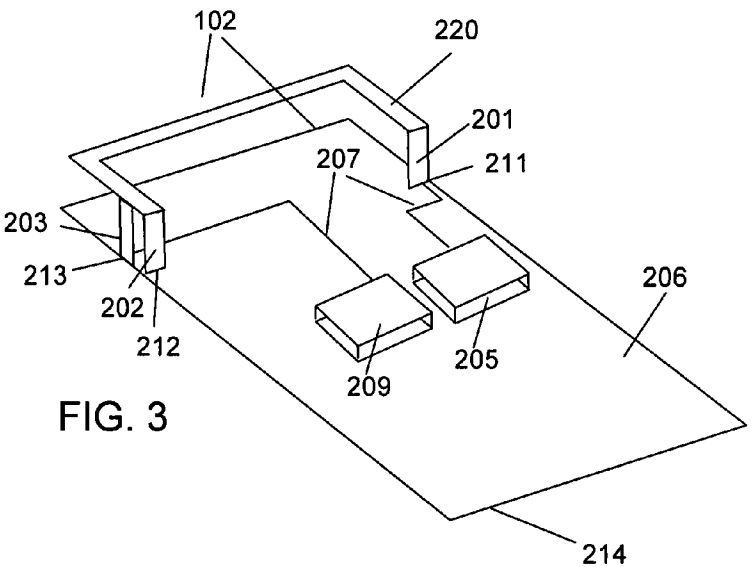
FIG. 3 shows a perspective view of the antenna apparatus of the present invention according to a second preferred embodiment.

FIG. 3 shows a perspective view of the apparatus shown in FIG. 1 according to a second preferred embodiment. As is evident, radiating element 220 is shown comprising a piece of conductive-strip, wire, or metal strip located over ground plane 214 embedded within substrate 206. In the second preferred embodiment radiating element 220 is folded, taking on a "U-shape" to reduce dimensions, with the opening of the "U" being rotated 90 degrees from that shown in FIG. 2. As is evident, radiating element 220 is still supported by three legs 201, 202, and 203, each serving the function set forth above.

Figure 4:
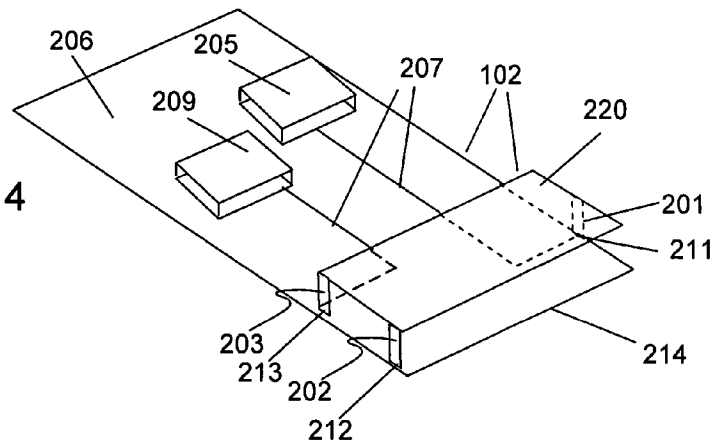
FIG. 4 shows a perspective view of the antenna apparatus of the present invention according to a third preferred embodiment.

FIG. 4 shows a perspective view of apparatus shown in FIG. 1 according to a third preferred embodiment. In the third preferred embodiment, radiating element 220 comprises a metallic plate that is again suspended above substrate 206, and supported by three legs 201, 202, and 203. As with the above embodiments, legs 201-203 serve solely as a tuning port, a ground, and a feed port, respectively at points 211-213, respectively. More particularly, as with all the above embodiments, radiating element 220 is formed utilizing a two-port structure. One port (213) is utilized solely as an antenna feeding port, while another port (211) is utilized solely as a tuning port loaded by a switched tuning network and is placed maximally distal from the feeding port along the route of radiating element 220.

Figure 5:
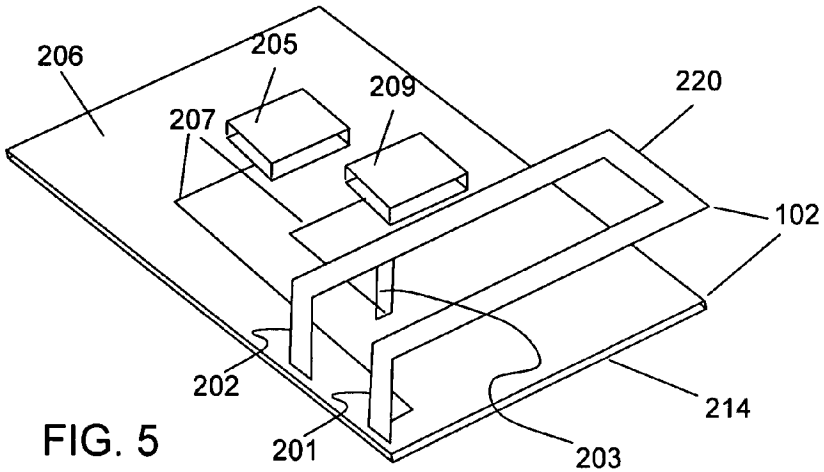
FIG. 5 shows a perspective view of the antenna apparatus of the present invention according to a fourth preferred embodiment.
Figure 6:
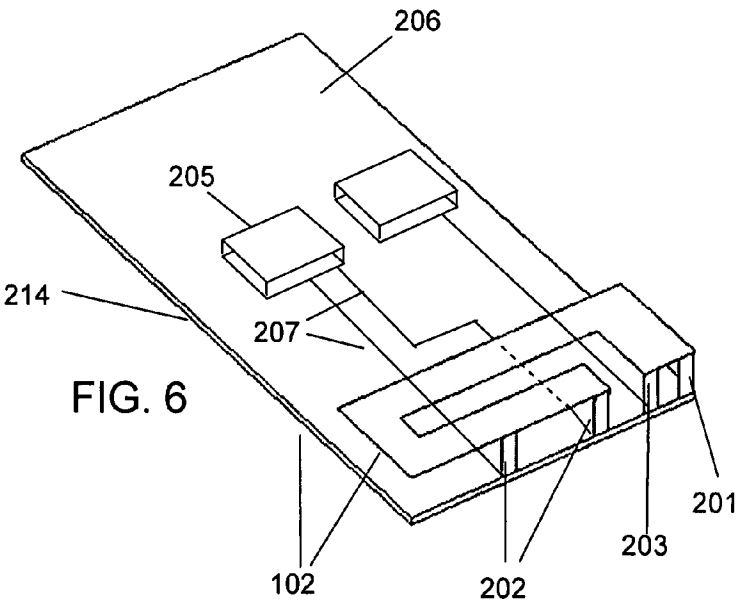
FIG. 6 shows a perspective view of the antenna apparatus of the present invention according to a fifth preferred embodiment.
Figure 7:
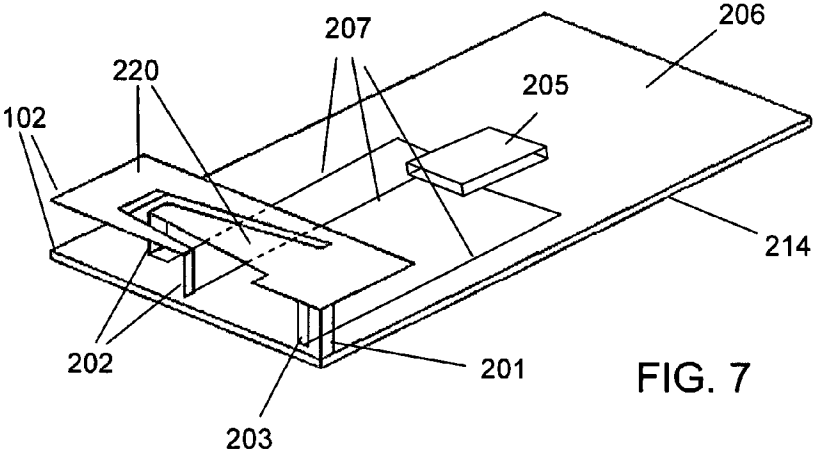
FIG. 7 shows a perspective view of the antenna apparatus of the present invention according to a sixth preferred embodiment.

While the invention has been particularly shown and described with reference to a particular embodiment, it will be understood by those skilled in the art that various changes in form and details may be made therein without departing from the spirit and scope of the invention. Some of these changes are shown in FIGS. 5, 6, and 7. It should be noted that reference numerals 211-213 have been omitted from FIGS. 5, 6, and 7 for clarity. The antenna system disclosed in FIG. 5 features a structure similar to that in FIG. 2, with the main difference that the tuning function performed by port 211/leg 201 and the feeding and grounding functions performed by port 213/leg 203 and port 212/leg 202 are applied on reversed ends of the radiating element 220. The antenna system disclosed in FIG. 6 features multiple tuning ports 201, with additional tuning port placed between the first tuning port and feeding port, which allows an increased number of tuning states by combining the reactance settings at both ports and allow additional tuning states not achievable through only the first tuning port. The antenna system disclosed in FIG. 7 has multiple tuning ports 201 that may be utilized for to tune independently the antenna response in a dual-band antenna system. This radiating element 220 has the same ground and feeding port described above and which has two distinctive radiating parts (arms) responsible mainly for each of two frequency bands. In this case instead of one tuning port there exist two tuning ports connected to the above-mentioned arms with all the characteristics and switched tuning networks described above. It is intended that such changes come within the scope of the following claims.

The invention claimed is:

1. An antenna system (100) comprising:

a ground structure (214);

a radiating element (220) electrically coupled to the ground structure at a first (211), second (212), and a third (213) point;

wherein the first point is utilized as a ground for the radiating element;

wherein the second point is utilized as a tuning port for the radiating element;

wherein the third point is utilized as a feed port for the radiating element; and wherein the tuning port is substantially maximally distal to the feed port along the radiating element.

2. The antenna of claim 1 further comprising:

a plurality of reactive loads coupled to the tuning port.

3. The antenna of claim 2 wherein the plurality of loads comprises a transmission line, strip line, or micro-strip line.

4. The antenna of claim 2 further comprising:

variable reactance tuning circuitry coupled to the tuning port.

5. The antenna of claim 1 wherein the radiating element is supported above the ground plane by the first, second, and third legs.

6. The antenna of claim 1 wherein the radiating element comprises a conductive-strip, piece of wire, or metal strip.

7. The antenna of claim 1 wherein a length of the radiating element is a quarter wavelength at a lowest tuning frequency.

8. The antenna of claim 1 wherein the radiating element is folded, taking on a "U-shape".

9. The antenna of claim 1 wherein:

the first point is utilized solely as a ground for the radiating element;

the second point is utilized solely as a tuning port for the radiating element; and the third point is utilized solely as a feed port for the radiating element.

10. The antenna of claim 1 wherein the radiating element comprises a metallic plate.

11. An antenna system (100) comprising:

a ground structure (214);

a radiating element (220) supported above the ground structure and electrically coupled to the ground structure via a first (201), second (202), and a third (203) leg;

wherein the first leg is utilized as a ground for the radiating element;

wherein the second leg is utilized as a tuning port for the radiating element;

wherein the third leg is utilized as a feed port for the radiating element; and wherein the second leg is substantially maximally distal to the third leg along the radiating element.

12. The antenna of claim 11 further comprising:

a plurality of loads coupled to the second leg.

13. The antenna of claim 12 wherein the plurality of loads comprises a transmission line, strip line, or micro-strip line.

14. The antenna of claim 12 further comprising:

variable reactance tuning circuitry coupled to the second leg.

15. The antenna of claim 11 wherein the radiating element comprises a conductive-strip, piece of wire, or metal strip.

16. The antenna of claim 11 wherein a length of the radiating element is a quarter wavelength at a lowest tuning frequency.

17. The antenna of claim 11 wherein the radiating element is folded, taking on a "U-shape".

18. The antenna of claim 11 wherein:

the first leg is utilized solely as a ground for the radiating element;

the second leg is utilized solely as a tuning port for the radiating element; and the third leg is utilized solely as a feed port for the radiating element.

19. The antenna of claim 11 wherein the radiating element comprises a metallic plate.

* * * * *